United States Patent [19]

Callaway

[11] 4,424,600

[45] Jan. 10, 1984

[54] ADJUSTABLE FIRMNESS MATTRESS PILLOW TOP

[75] Inventor: Milton A. Callaway, Jackson, Oreg.

[73] Assignee: Simmons U.S.A. Corporation, Atlanta, Ga.

[21] Appl. No.: 276,155

[22] Filed: Jun. 22, 1981

[51] Int. Cl.[3] ..... A47C 27/18; A47G 9/00

[52] U.S. Cl. ..... 5/470; 5/455; 5/464; 5/485; 5/486; 5/500; 5/502

[58] Field of Search ..... 5/482, 485, 470, 471, 5/462, 464, 465, 449–457, 474, 500, 502, 486

[56] References Cited

U.S. PATENT DOCUMENTS

| | | | |
|---|---|---|---|
| 10,139 | 10/1853 | Scott . | |
| 133,093 | 11/1872 | Graham . | |
| 1,218,291 | 3/1917 | Meinecke . | |
| 1,356,148 | 10/1920 | Hobert . | |
| 1,371,362 | 3/1921 | Giese . | |
| 2,504,352 | 4/1950 | Robell . | |
| 2,651,788 | 9/1953 | Forwood . | |
| 2,779,034 | 1/1957 | Arpin . | |
| 2,814,053 | 11/1957 | Sevcik . | |
| 2,823,394 | 2/1958 | Smith . | |
| 3,110,520 | 11/1963 | Herding . | |
| 3,166,768 | 3/1965 | Cunningham . | |
| 3,287,749 | 11/1966 | Marsico . | |
| 3,421,163 | 1/1969 | Stoughton . | |
| 3,534,417 | 10/1970 | Boyles . | |
| 3,587,568 | 6/1971 | Thomas . | |
| 3,775,781 | 12/1973 | Bruno . | |
| 3,789,442 | 2/1974 | Tobinick . | |
| 3,950,798 | 4/1976 | Borsini . | |
| 3,958,286 | 5/1976 | Rodinsky | 5/451 |
| 4,015,299 | 4/1977 | Tinnel | 5/451 |
| 4,213,214 | 7/1980 | Gilmooly | 5/451 |
| 4,234,983 | 11/1980 | Stumpf . | |
| 4,234,984 | 11/1980 | Stumpf . | |
| 4,245,363 | 1/1981 | Callaway . | |

FOREIGN PATENT DOCUMENTS

| | | | |
|---|---|---|---|
| 496756 | 4/1930 | Fed. Rep. of Germany | 5/474 |
| 1937428 | 2/1971 | Fed. Rep. of Germany | 5/455 |
| 262574 | 12/1926 | United Kingdom | 5/449 |

*Primary Examiner*—Alexander Grosz

*Attorney, Agent, or Firm*—Scully, Scott, Murphy and Presser

[57] ABSTRACT

A mattress construction in which the firmness of the top surface is selectively adjustable. A mattress body provides the primary support for a person lying on top thereof. A removable pillow top covers the mattress body, and is removably fastened thereto along its peripheral edges. A relatively thin fluid inflatable cushion is positioned beneath the removable top such that the pressure in the cushion can be varied to alter the firmness of the mattress top surface.

12 Claims, 9 Drawing Figures

ADJUSTABLE FIRMNESS MATTRESS PILLOW TOP

BACKGROUND OF THE INVENTION

1. Field of the Invention

The present invention relates generally to a mattress the firmness of which is readily adjustable, and more particularly pertains to an adjustable firmness mattress pillow top construction in which a selectively inflatable cushion is removably incorporated within the pillow top of the mattress.

2. Discussion of the Prior Art

The use of mattresses having inflatable chambers as an integral part of their construction is well known in the art.

For instance, Sevcik U.S. Pat. No. 2,814,053 discloses a mattress construction having structure for inflating the mattress to conform the upper reclining or sleeping surface to a contour desired to give maximum sleeping comfort. The arrangement compensates for any sagging or uneveness developed in the upper surface which might adversely affect the sleeping comfort of the occupant or occupants. The disclosed embodiments generally incorporate an inflatable envelope positioned at the bottom or middle of the mattress, on top of which are placed typical coil springs with a top pad of fibrous material, or alternatively a relatively thick layer of foam material is positioned on top to support a person lying on the mattress. In the disclosed arrangements, the inflatable envelope, which is longitudinally or transversely divisible into multiple sections, permits selective inflation of the sections to compensate for changes in the contour of the mattress caused by wear, etc. The firmness of the mattress is not adjustable, it being determined primarily by the types of coil springs, top pads, or thick layer of foam material.

Smith U.S. Pat. No. 2,823,394 discloses a mattress having a pneumatic core divided into a plurality of independently inflatable cells positioned in an outer flexible envelope. In this arrangement, a top padding is provided on top of the inflatable cells, and although the pneumatic pressures in the cells would undoubtedly have some effect on firmness, the pneumatic cells are provided primarily for support and not as an adjustment for the firmness of the mattress.

Stoughton U.S. Pat. No. 3,421,163 illustrates an orthopedic cushion which serves as a back rest cushion and combines an air cushion with a foam backing. The cushion has a relatively inflexible back board, in front of which is positioned a resilient cushion of a material such as foamed polymer composition. A separate air envelope is positioned in front of the foam cushion, and is adapted to be inflated to provide air cushion support. In this arrangement, the air envelope is provided as an integral part of the support structure, and again is not utilized to adjust firmness.

The prior art does not provide a mattress having a primary support, on top of which an inflatable cushion, covered by a removable mattress pillow top, provides an adjustment for the firmness of the mattress. Moreover, in designing a mattress of this type, it should be borne in mind that a mattress is a complex supporting structure, of elastic and plastic deformability, subject to both static and dynamic stresses. It must be elastic in order to allow a determined amount of depression in response to a load, while not substantially altering the axis of the load, i.e. of the human body lying down. The mattress also has further functions such as that of allowing transpiration of the supported body, and it must also have suitable thermal characteristics. All of these factors must be taken into account in the design of a mattress having an adjustable firmness, making the construction of such a mattress a rather complex project.

SUMMARY OF THE INVENTION

Accordingly, it is a primary object of the present invention to provide a mattress having a pillow top surface, the firmness of which is selectively adjustable.

A further object of the subject invention is the provision of a mattress of the aforementioned type in which an inflatable cushion is removably positioned beneath a pillow top for the mattress, which is selectively removable from the mattress.

In accordance with the teachings herein, the present invention provides a mattress construction in which a mattress body is designed to provide the primary support for a person lying on top thereof. A removable pillow top covers the mattress body, and is removably fastened thereto along its peripheral edges. A fluid inflatable cushion is positioned beneath the removable pillow top such that inflation of the cushion can be varied to alter the firmness of the mattress top surface.

In one embodiment, a layer of high density foam is also positioned beneath the inflatable cushion, and the removable pillow top is a quilted mattress top. The inflatable cushion may also be divided into two separately inflatable chambers, one for each half side of the mattress, such that the firmness of each half of the mattress is separately adjustable.

An important consideration in mattress construction lies in the provision of a mattress which affords a maximum degree of comfort to the individual user, in effect, with respect to the firmness obtained through the internal construction thereof, particularly with regard to the center portion of the mattress which is subjected to extensive usage. Inasmuch as different users often prefer mattresses having a wide variety of consistencies and degrees of firmness, it is readily understandable that, in order to be able to satisfy a broad range of consumer demands, this would necessitate the manufacture of many types of mattresses affording the consumer a wide choice of selection. Obviously this presents problems in the economy of manufacturing and stocking of a large supply of mattresses having different characteristics and firmness in order to be able to meet most consumer needs.

In order to ameliorate these problems, there has been developed the concept of providing a basic mattress frame or perimeter construction which, in combination with a replaceable and interchangeable core portion forming the major supporting area of the mattress, facilitates a rather inexpensive manufacture of the mattress while imparting a versatility in construction and adaptability to consumer needs not heretofore encountered in the prior art.

An important aspect of a particular embodiment of the present invention resides in the provision of a pillow top surface, the firmness of which is selectively adjustable, for a mattress having an insertable core which facilitates an adaptability for showroom demonstration and emphasizes the versatility thereof to potential customers. In effect, the insertable and interchangeable core imparts a customized property to the mattress without the need for expensive modifications to the basic mattress construction. Thus, a wide range of customer needs and individual tastes can be demonstrated in a simple and inexpensive manner through a simple interchange of the core portion of the mattress in a standardized outer perimeter frame structure.

Another feature of the inventive mattress arrangement consists of its ready adaptability to field servicing and replacement of worn or damaged mattress components without the need to return the mattress to a factory or the requirement for skilled servicing personnel.

In addition to the foregoing, the insertable core allows for the insertion therebeneath of an orthopedic bed board into the perimeter support structure by either the user or by personnel in the retail outlet selling or servicing the mattress arrangement. This, of course, again enlarges the scope of application of the mattress arrangement to a wider public and enhances the saleability of the product.

Yet another feature of a particular disclosed embodiment of the present invention comprises the provision of a mattress arrangement as described herein which is adapted for showroom demonstrations of numerous variations thereof so as to apprise potential customers of the versatility of the arrangement.

BRIEF DESCRIPTION OF THE DRAWINGS

The foregoing objects and advantages of the present invention for a pneumatically adjustable mattress may be readily understood by one skilled in the art with reference being had to the following detailed description of several preferred embodiments thereof, taken in conjunction with the accompanying drawings wherein like elements are designated by identical reference numerals throughout the several drawings and in which.

DETAILED DESCRIPTION OF THE DRAWINGS

Figure 1:
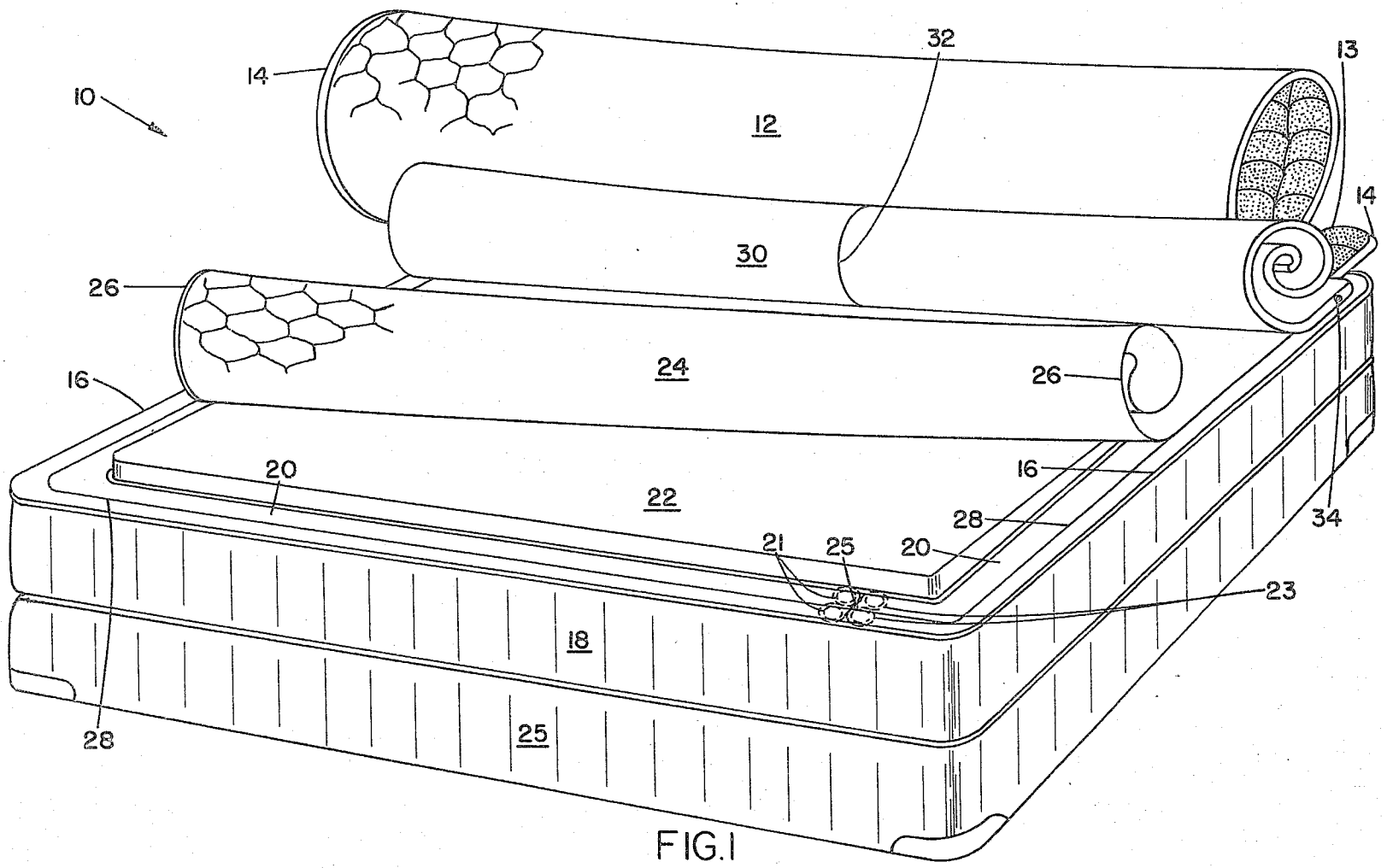
FIG. 1 is a perspective view of an exemplary embodiment of a mattress having a removable pillow top with a removable pneumatically adjustable cushion thereunder which is constructed pursuant to the teachings of the present invention.

Referring to the drawings in detail, FIG. 1 is a perspective view of an exemplary embodiment of a mattress 10 constructed with a removable pillow top cover 12. Pillow top 12 may have a suitably quilted cloth top 13, and has a fastener track 14 provided around its rectangular peripheral edge. A corresponding fastener track 16 is provided around the rectangular peripheral edge of a mattress body 18, such that the pillow top 12 and mattress body 18 may be fastened together or separated from each other.

Figure 4:
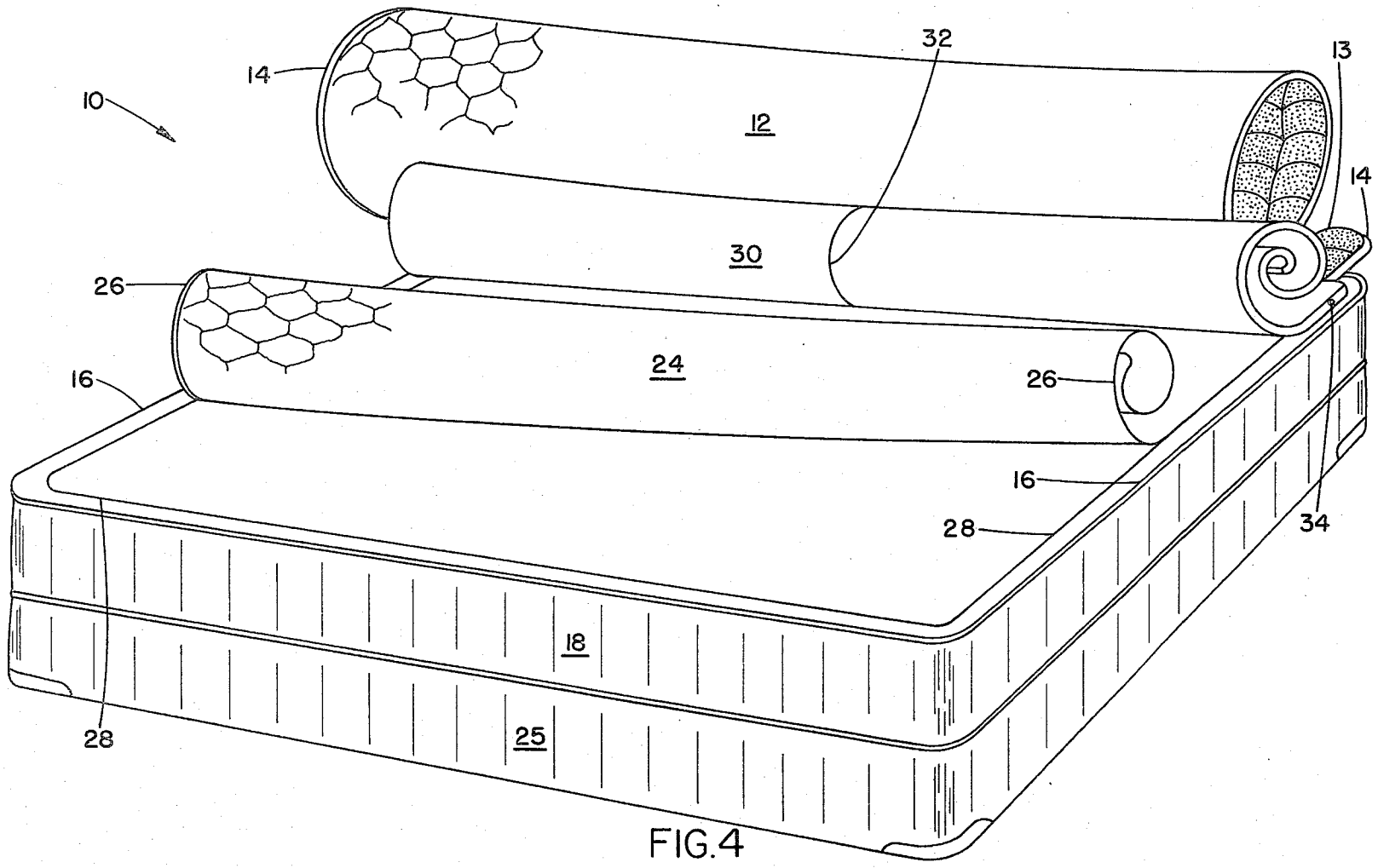
FIG. 4 illustrates a further exemplary embodiment of the present invention similar in concept to that shown in FIG. 1, but wherein the removable pillow top is utilized in combination with a conventional mattress.

Mattress body 18 may be a traditional type of mattress having one unitary body as illustrated in FIG. 4, but is preferably constructed of two separable components, an outer peripheral frame section 20 and a removable core unit 22, illustrated in a partially inserted position in FIG. 1 for clarity of detail. With this type of construction, the core unit 22 is replaceable, and may be selected at the time of purchase to be soft, firm, extra firm, etc. Alternatively, the core unit may take different types of construction such as for instance a foam rubber construction or a traditional coil spring construction or a fluid filled construction, or variations and combinations on these different types of construction. A pillow top 12 may also be removably fastened to the bottom of mattress body 18, such that a very flexible, interchangeable arrangement of components is presented thereby.

A sheet liner 24 is optionally positioned on top of the core unit, and includes a fastener track 26 provided around its rectangular peripheral edge. A corresponding fastener track 28 is provided in a rectangular pattern on the top surface of peripheral mattress component 20, such that the liner may be fastened to peripheral component 20. The fasteners are preferably zippers of the type that they are concealed, as by a flap, after closure thereof. In other embodiments the fasteners can be Velcro® type fasteners. The aforementioned flexible type of mattress construction is disclosed in copending patent application Ser. No. 275,956 entitled Bed Mattress, commonly assigned herewith. The mattress rests upon a box spring 25 which may have a traditional type of construction.

The outer frame structure 20 may include encompassing upper and lower border wires consisting of inner and outer wires of round, rectangular or any suitable cross-section which are interconnected to a plurality of coil springs extending about the perimeter of the frame structure. The wires and the coil springs form a generally rigid but resiliently yieldable rectangular mattress frame adapted to comfortably support the weight of a person sitting on the edge of the mattress while concurrently maintaining the shape of the mattress. The wires and coil springs may be formed of metal or of a suitable plastic material such as vinyl. The outer frame structure 20 may be covered on all exposed sides thereof with a suitable covering material such as mattress ticking, or a tufted or quilted mattress pillow material which imparts a soft and luxurient look and feel to the mattress. The mattress covering material may, if desired, consist of an either woven or non-woven breathable fabric, such as synthetic fiber material, cotton or combinations of materials which afford the necessary comfort to a user resting or sleeping on the mattress. Moreover, the mattress arrangement may incorporate a mattress pillow top filled with down or other soft foam-like material which will impart a particularly full and luxurient look and texture to the mattress.

In lieu of the inner and outer border wires and the coil springs, the peripheral frame structure 20 may be constructed of pocketed springs, or may be constituted of a plastic or foamed material. Thus, for instance, the peripheral frame structure 12 may consist of a rectangular or so-called "square" array or arrangements of non-nested coil springs 21 in the individual pockets 23 in which adjacent pocketed strips of springs are interconnected at 25 by connecting the fabric strips together between springs, for example, by stitching, seaming or ultrasonic welding of the seams of the material or of the fabric strips, the material preferably being non-woven thermoplastic fiber material, rather than by connecting of the springs so that the interconnection of any spring with its adjacent springs is accomplished in the same manner, in essence, through the material in which the spring is housed. This type of pocketed coil spring structure eliminates the tendency exhibited by nested assemblies of pocketed coil springs to trap an individual coil or coils in a partially compressed condition. A structure of the nature is disclosed in Stumpf U.S. Pat. No. 4,234,984 assigned to the Simmons Company, the disclosure of which is incorporated herein by reference.

Figure 5:
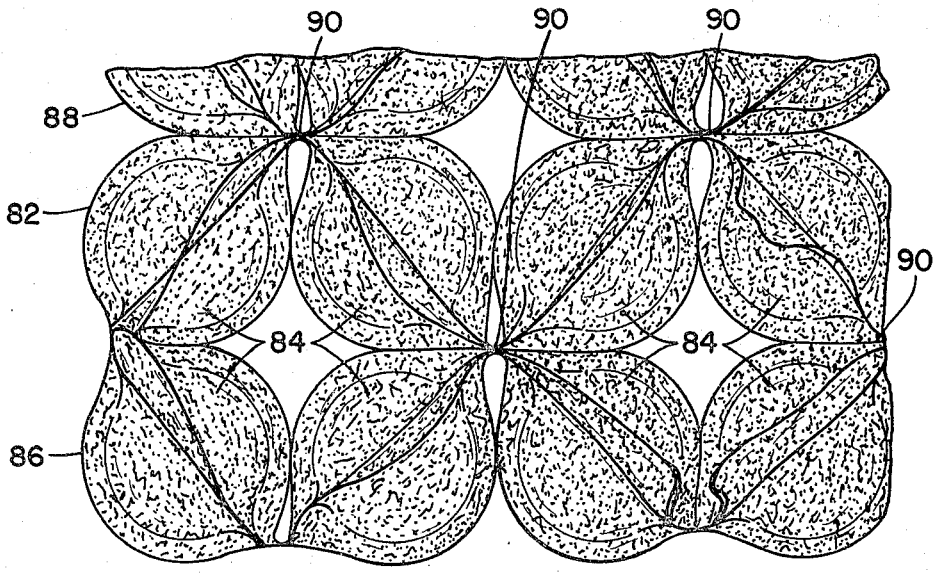
FIG. 5 is an enlarged plan view of a corner face of a rectangular pocketed spring assembly, with the springs disposed in non-nested square array, which may also be used in the mattress construction herein.
Figure 6:
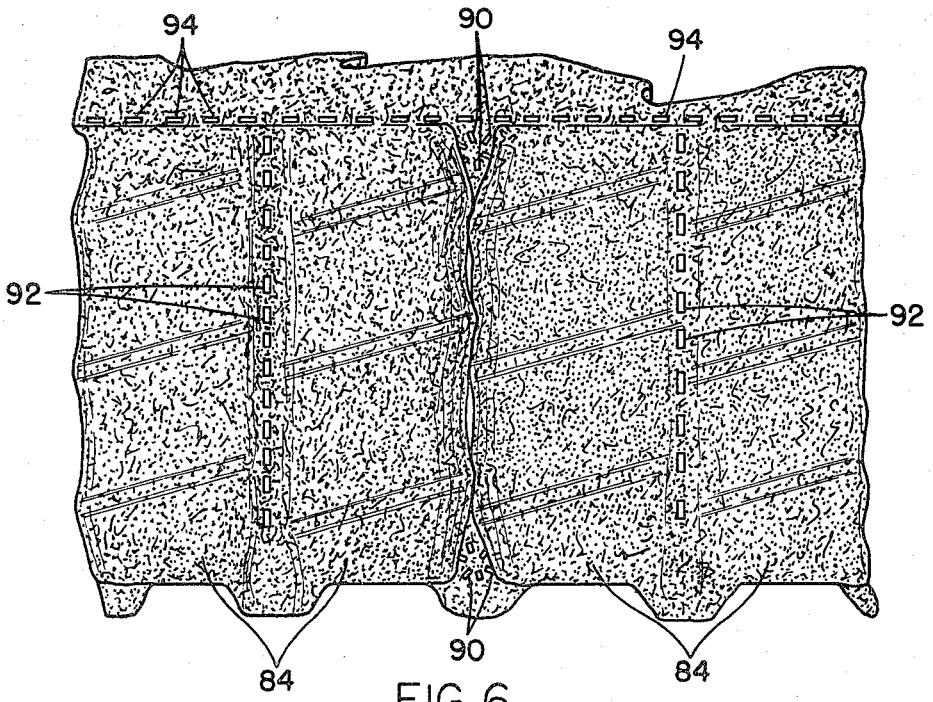
FIG. 6 is a fragmentary elevational view of the assembly of FIG. 5.

In greater detail, in the Stumpf construction which is illustrated in FIGS. 5 and 6, a pocketed spring assembly has a given strip 82 of pocketed springs 84 connected to each adjacent strip 86 and 88 by connecting the two fabric strips together. Although the overall pattern of the assembly may tend to confuse the eye, reference should be made initially to the fragmentary enlargements of FIGS. 5 and 6, from which it is more readily apparent that the connections 90 of a given strip of springs to its neighboring strip are made between a pair of successive springs 84 of each strip, and are alternated along any given strip, e.g., strip 82, so that the given strip is connected first to the neighboring strip on one side, e.g., strip 86, and then to the neighboring strip on the opposite side, e.g., strip 88, and so forth, along the entire given strip from one end or side of the assembly to the other.

The interstrip connections 90 are conveniently, although not necessarily, made near the opposite faces of the spring assembly, where, because of the preferred barrel shape of the coil, the slack of the fabric between successive pockets near the ends of the coils facilitates the insertion of a tool appropriate to make the connection.

As a result of the connection, the pair of coils of each strip immediately adjacent to the interstrip connection 90 are joined with an opposing pair in a configuration which, in plan, resembles a four-leaf clover, each spring pocket being rotated approximately one-eight turn away from the longitudinal axis of its own strip.

The strips of pocketed coils 88 chosen to illustrate the invention are produced commercially, and comprise a folded two-ply strip of non-woven fabric of thermoplastic fibers in which the spring pockets are defined between the plies by transverse lines 92 of discrete thermal welds of the plies to one another, and in which the pockets formed in the two-ply strips are closed by a longitudinal seam 94 of similar thermal welds to confine the springs in the pockets. When the springs are permitted to expand after being confined within the pockets, they impose their shapes upon the confining pocket walls in the mid-height of the pockets and produce a ruffle in the flaps of the closing seam, and at the opposite non-seamed end of the spring pocket as well, as the separation of the plies by the expanded spring foreshortens the cloth strip. This results in a slack reach of fabric along the interpocket seam 92 at each end thereof, an effect accentuated somewhat by the barrel shape of the coil 84 with which the invention is specifically illustrated.

The divergence of adjacent spring coils 84 at their ends resulting from the barrel shape provides convenient access to the strip material which, in the illustrated instance is welded to the material of the adjacent strip in the corresponding reaches of fabric between two successive coils of each strip, so that in the presently preferred and illustrated form, the adjacent strips are connected together, as at 90 near the tops and bottoms of the coils, but preferably interiorly of the end convolutions thereof.

The assembly of springs by connecting the strips together rather than by connecting the springs, as such, to one another, permits each spring to maintain a considerable degree of individual action before requiring the depression of its neighbors in the clover leaf array, and yet, beyond that point, as in areas of concentrated load under the proportionally heavier parts of the body, or when the spring assembly is highly loaded as by bearing the weight of the occupant in sitting position, the clover leaf connection of four springs together in a closely knit group associates them cooperatively so that each can assist the other to regain the full unloaded height permitted by the confining pocket when the concentrated load is subsequently removed.

The pocket material of the preferred assembly is a thermoplastic sheeting, preferably of fibrous material whether or not of continuous filament or staple fiber length, and whether spun and woven, or laid as a non-woven fabric. When the constituent material is thermoplastic, as indicated, the joining technique employed in making the assembly, as well as making the pocketed spring strip itself, may be thermal welding, a localized or spot attachment of adjacent strips being made at or near the end convolutions of the springs along the seam between adjacent pockets in that relatively slack reach of the pocket material provided by the diverging outlines of the barrel-shaped spring coils resulting from the smaller diameter of their respective end convolutions. These connections can readily be made with available welding equipment, and do not appear to interfere materially with compression of the springs individually throughout a substantial portion of their respective heights.

Based upon the considerable history of manufacture of pocketed spring coil assemblies wherein the pocket materials were of spun and woven staple fibers of natural origin, the specific mode of attachment of adjacent strips to one another in accordance with the construction may be something specifically different from thermal welding, the ultimate objective being the secure, reliable, and non-destructive attachment of the adjacent strips to one another. This may, for example, take the form of stitching, or twine ties, or metal fasteners such as hogrings, staples, or the like, or an adhesive capable of adequately penetrating the four plies of a textile fabric with or without heat and pressure.

The peripheral frame structure may consist of non-nested pocketed upholstery springs assembled into the so-called Marshall construction as described in Stumpf U.S. Pat. No. 4,234,983, assigned to the Simmons Company, the disclosure of which is also incorporated herein by reference. In this instance the pockets with the individual coil springs are formed between overlaid plies of a two-ply strip of material by lines of separate individual welds which interconnect the plies. These welds between the material plies may be effected in an ultrasonic method and arrangement.

Figure 7:
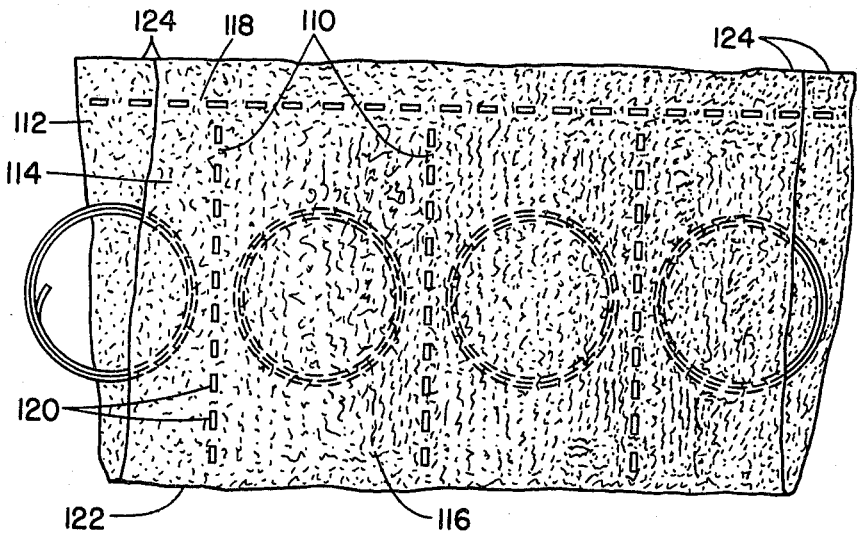
FIG. 7 is an enlarged plan view of a series of pocketed springs of the so-called Marshall construction which may be utilized, in the mattress construction herein.
Figure 8:
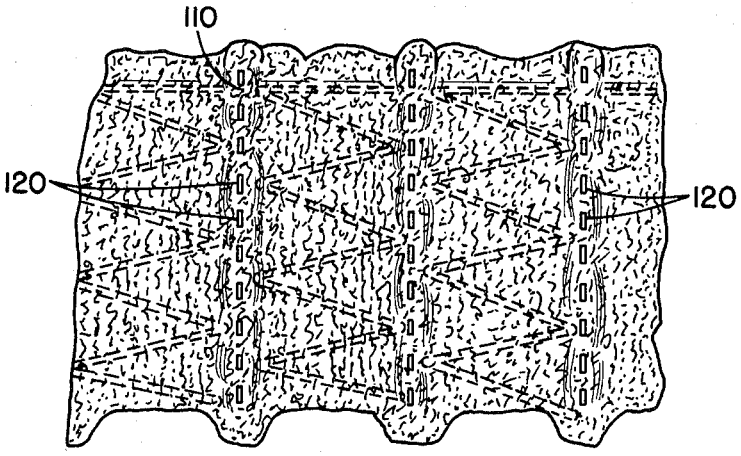
FIG. 8 is a fragmentary elevational view of the springs of FIG. 7.

In greater detail and as illustrated in FIG. 7 and 8, the transverse lines of attachment 110 of the overlaid plies 112 and 114 of the strip 116 to each other to define the spring pockets, as well as the line 118 of the attachment which closes the pockets along the side edges of the plies between which the spring was inserted, are formed of discrete individual welds 120 rather than as a continuous weld. It will also be observed that, as illustrated, the individual welds 120 are spaced apart within the line by a distance approximately equal to the length of the individual welds along the line, and, further, that the welds at each end of the transverse lines 110 of welds between the pockets do not intercept either the folded edge 122 of the fabric strip 16 or its overlaid edges 124 between which the spring was inserted.

With an interrupted line of thermal welds and using non-woven polypropylene fabric earlier referred to, a line of interrupted welds each a quarter-inch long and approximately one-eight inch wide and separated from each other by approximately one-quarter inch in the line, exhibits over forty percent (40%) greater resistance to separation of the pocket-forming plies than the identical material sewed on production equipment for the manufacture of pocketed springs by the conventional stitching method, using thread which is conventional for the single-thread interpocket stitching, viz. Number 30-3 soft cotton.

While thermal welding in the prescribed pattern may be achieved in a variety of ways, including contact heating and high frequency welding, the ultrasonic welding technique appears to be especially suitable in that the internal induction of heat by its mechanical working of the material is faster than contact heating, and more controllable as well as less dangerous than high-frequency electrostatic methods. Moreover, within limits, any desired pattern of welding can be achieved ultrasonically in this context by suitable modification of the anvil against which the material to be welded is pressed by the welding horn.

The outer peripheral frame structure 20 may also be constructed of rigid plastic material components and of foamed plastic cushioning material in lieu of the springs or in combination therewith.

The inner mattress core may be covered with a suitable covering material on all sides thereof such as mattress ticking. When the core is constituted of pocketed coil springs, they may be covered by a muslin forming the pocket fabric which, in turn, may comprise the covering material of the mattress core. The inner mattress core may also have a structure or physical characteristic in conformance with the needs of the user or purchaser of the mattress. For example, the core 22 may be formed of a coil spring arrangement including border wires; or may be constructed of non-nested pocketed coil springs pursuant to either Stumpf U.S. Pat. Nos. 4,234,983 or 4,234,984; or may incorporate a flotation or waterbed mattress center as shown in Callaway U.S. Pat. No. 4,245,363; or may have a pneumatic or foam-filled core construction.

In certain instances, so as to impart to the mattress arrangement a still fuller and more luxurient look, a unitary piece of foamed material or sponge-like rubber material may be inserted in the cavity beneath the mattress core. This will cause the center position of the mattress to arc upwardly into a dome shape, generally referred to as a "loft" appearance, thereby creating an especially attractive and expensive appearing mattress.

Pursuant to the teachings of the present invention, a pneumatically adjustable cushion 30 in the form of a rectangular inflatable pad or panel is placed on top of an optional liner 24 after zippering of the liner in place on top of core unit 22 and peripheral unit 20. The liner 24 is an optional component of this arrangement and can be omitted in some embodiments. The pneumatic pad 30 is laid flat on top of the remaining mattress structure, and pillow top 12 is then fastened in place over the cushion pad 30, thereby securing the latter component in position. In one preferred embodiment, the adjustable cushion 30 is preferably fairly thin, approximately one and one half inches thick after inflation, and is constructed with left and right independently inflatable chambers separated by a common central wall 32 between the chambers and extending longitudinally along the length of the mattress. Each chamber is provided with a separate air valve 34, only one of which is illustrated, such that the firmness of each half of the mattress is independently adjustable. In alternative embodiments, the valves 34 could be located at any convenient location on the cushion such that they are readily accessible for adjustment of the pneumatic pressure therein.

Figure 2:
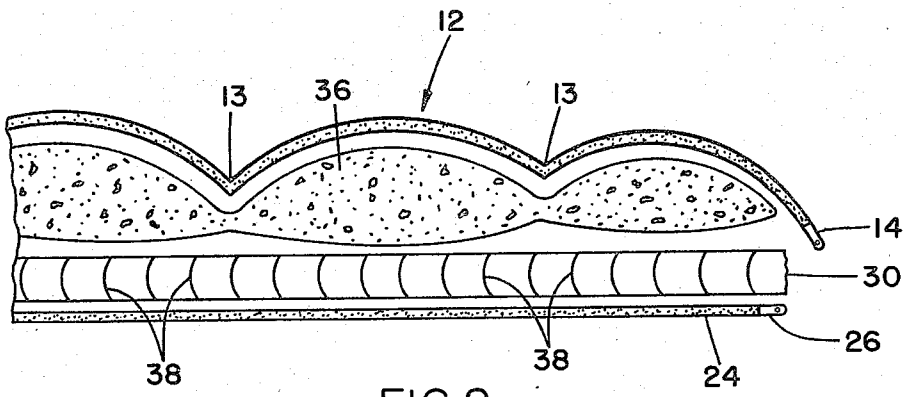
FIG. 2 illustrates an elevational sectional view of a first embodiment of a mattress construction having a pneumatically adjustable cushion positioned therein.
Figure 3:
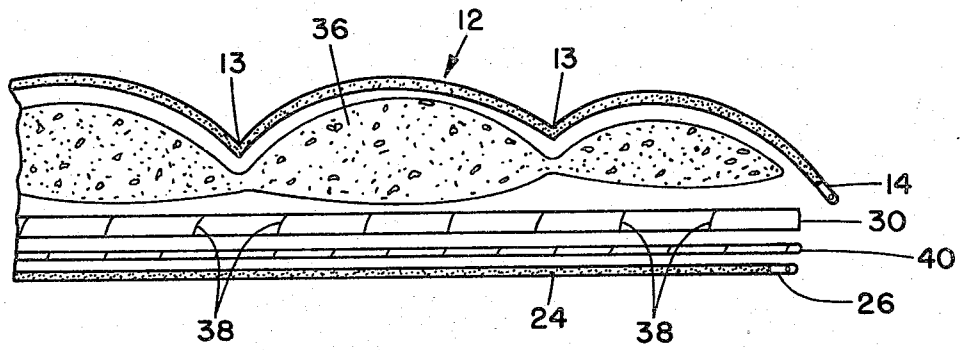
FIG. 3 is an elevational sectional view of a second embodiment of a mattress construction having a pneumatically adjustable cushion and an additional layer of high density foamed plastic beneath the cushion therein.

FIGS. 2 and 3 illustrate elevational sectional views through two different embodiments of the present invention wherein the pillow top 12 includes a quilted cloth top 13, quilted with respect to a layer of super soft foam 36 therebeneath. In the illustrated embodiments, the inflatable cushion is provided with a plurality of longitudinally extending internal ribs 38 to ensure that the cushion retains a relatively flat upper surface in an inflated condition. The ribs do not define separate compartments in the cushion, such that air is free to circulate through the ribs 38 during inflation.

In the embodiment of FIG. 3, a high density foam pad 40 is placed beneath the pneumatic cushion 30 to enhance the firmness of the mattress top. In one embodiment, the thickness of the high density foam pad was chosen to be approximately three quarters of an inch.

Figure 9:
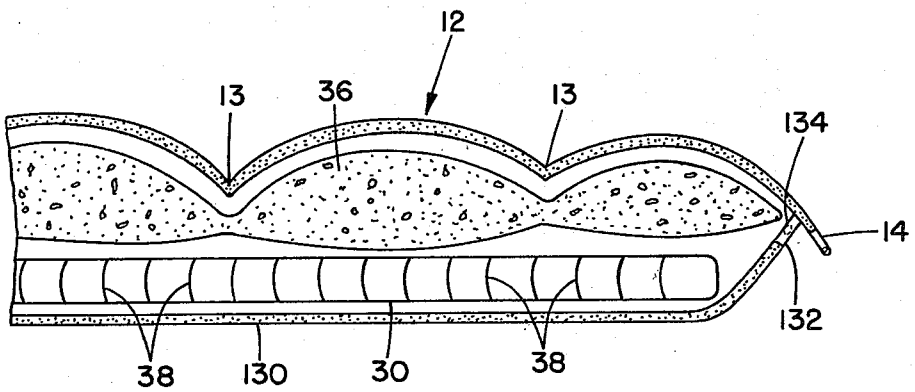
FIG. 9 is an elevational sectional view of a pillow top construction similar to that shown in FIG. 2, but wherein the pneumatic cushion is incorporated within the pillow top.

FIG. 9 is an elevational sectional view of an embodiment of a pillow top construction wherein the pillow top 12 incorporates therein the pneumatically adjustable cushion 30. The pillow top 12 includes a bottom liner 130 having a fastener track 132 attached to its peripheral edges. The pillow top 12 includes a corresponding fastener track 134 around its bottom peripheral edges such that the liner 130 is removably fastened to the underside of pillow top 12, such that pneumatic cushion 30 may be removably positioned within the pillow top. Pillow top 12 is in turn removably fastenable to the mattress body by zipper 14.

While several embodiments and variations have been described in detail herein, it should be apparent that the teachings and disclosure of the present invention will suggest many other embodiments and variations to those skilled in the art. For instance, the fasteners could be any suitable fastener such as snap fasteners, and the quilted top surface 13 could also be replaced by any suitable mattress surface. The adjustable cushion might also be divided longitudinally or transversely into multiple sections to provide more selective control over the firmness of the various sections of the mattress.

What is claimed is:

1. An adjustable mattress construction, comprising:

a. a mattress body designed to provide the primary support for a person lying on top thereof;

b. a pillow top removably fastened to said mattress body; said pillow top having a bottom liner detachably fastened thereto and c. a relatively thin, fluid inflatable cushion pressurizable to a variable firmness removably positioned within said pillow top to permit adjustment of the firmness of said pillow top said inflatable cushion being arranged between the lower surface of said pillow top and said bottom liner, said pillow top and inflatable cushion substantially covering the top of the mattress body.

2. An adjustable mattress construction as claimed in claim 1, said pillow top being removably fastened to said mattress body by a fastener extending around the peripheral edge of said mattress body.

3. An adjustable mattress construction as claimed in claim 1, further including a layer of high density foam positioned beneath said inflatable cushion.

4. An adjustable mattress construction as claimed in claim 1 or 2 or 3, said pillow top comprising a quilted mattress top.

5. An adjustable mattress construction as claimed in claim 1 or 2 or 3, said inflatable cushion comprising two separately inflatable chambers, one for each half side of the mattress, such that the firmness of each half of the mattress is separately adjustable.

6. An adjustable mattress construction as claimed in claim 1 or 2 or 3, said mattress body including two separable components, an outer peripheral section, and at least one central core unit, whereby different core units can be placed in said outer peripheral section to provide a desired type of mattress construction.

7. A mattress construction as claimed in claim 6, said mattress peripheral section comprising pocketed coil springs.

8. A mattress construction as claimed in claim 7, said pocketed coil springs comprising non-nested coil springs.

9. A mattress construction as claimed in claim 7, said pocketed coil springs being interconnected through ultrasonic welding of the material housing said coil springs.

10. A mattress construction as claimed in claim 7, said coil springs being formed of a metallic material.

11. A mattress construction as claimed in claim 7, said coil springs being formed of a plastic material.

12. A mattress construction as claimed in claim 1, wherein said inflatable cushion comprises a pneumatically-inflatable pad having a thickness of about one and one-half inches after inflation.

* * * * *